US008267105B1

(12) United States Patent
Denmark, Jr.

(10) Patent No.: US 8,267,105 B1
(45) Date of Patent: Sep. 18, 2012

(54) PORTABLE MAGNETIC AWNING APPARATUS

(76) Inventor: Cleveland Denmark, Jr., Indianapolis, IN (US)

( * ) Notice: Subject to any disclaimer, the term of this patent is extended or adjusted under 35 U.S.C. 154(b) by 0 days.

(21) Appl. No.: 12/956,314

(22) Filed: Nov. 30, 2010

(51) Int. Cl.
*E04H 15/06* (2006.01)
*E04F 10/10* (2006.01)

(52) U.S. Cl. ..... 135/117; 135/88.1; 135/88.13; 135/140; 160/62; 160/71; 296/163

(58) Field of Classification Search ..... 135/88.07, 135/88.1, 88.11, 88.15, 115, 117, 140, 145; 160/62, 71, 80; 52/74; 296/163
See application file for complete search history.

(56) References Cited

U.S. PATENT DOCUMENTS

| | | | | |
|---|---|---|---|---|
| 1,796,564 | A * | 3/1931 | Firguson | 160/62 |
| 2,583,824 | A * | 1/1952 | Dwinell et al. | 160/22 |
| 2,967,567 | A * | 1/1961 | Heckerman | 160/62 |
| 3,730,196 | A * | 5/1973 | Borskey | 135/88.11 |
| 6,619,726 | B2 | 9/2003 | Jones | |
| 6,908,138 | B2 | 6/2005 | Yang | |
| 7,086,684 | B2 * | 8/2006 | Glaser et al. | 296/99.1 |
| 7,967,050 | B2 * | 6/2011 | Gutierrez | 160/67 |
| 2004/0084072 | A1 | 5/2004 | Tien | |
| 2005/0199357 | A1 | 9/2005 | Dunn | |
| 2007/0000186 | A1 * | 1/2007 | Adams | 52/74 |
| 2010/0000689 | A1 * | 1/2010 | Ito | 160/22 |
| 2010/0027119 | A1 * | 2/2010 | Kollar et al. | 359/507 |

* cited by examiner

*Primary Examiner* — Winnie Yip

(57) ABSTRACT

The portable magnetic awning apparatus is easily attached to and removed from a chosen metallic vehicle or surface. Soft magnets negate potential scarring. In the collapsed state, the apparatus is importantly relatively small. The scissor frame supporting the awning easily collapses to allow the vertical members to be collapsed inwardly to a side-by-side position, with the pivoting members pivoting upwardly for further compact state. The pliable awning and bib further enable lightweight collapsibility. The pivoting members which are pivotally and positionally lockable, along with the telescopic rods, provide a wide variety of selectively established positioning and extendability. Lock knobs manually lock the pivoting members as chosen relative to the vertical members. The bib is hingedly attached to the awning to further provide selective positioning in relation thereto.

3 Claims, 4 Drawing Sheets

PORTABLE MAGNETIC AWNING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various vehicles, such as those designed for camping for example, have often employed awnings of various designs. Such awnings typically fall into two categories. First, factories and dealerships often offer to originally and permanently install such devices as options for a vehicle. Second, various awning kits are sometimes available for personal permanent installation. The present apparatus provides a portable, collapsible, pivotally adjustable, non-permanent awning with bib for magnetic attraction to various vehicles.

FIELD OF THE INVENTION

The portable magnetic awning apparatus relates to awnings and more especially to an awning for removable attachment to a variety of vehicles and surfaces.

SUMMARY OF THE INVENTION

The general purpose of the portable magnetic awning apparatus, described subsequently in greater detail, is to provide a portable magnetic awning apparatus which has many novel features that result in an improved portable magnetic awning apparatus which is not anticipated, rendered obvious, suggested, or even implied by prior art, either alone or in combination thereof.

To attain this, the portable magnetic awning apparatus provides the unique feature of being easily attached to and removed from a metallic vehicle of almost any sort. The soft magnets negate potential scarring while firmly attaching the apparatus to a vehicle side, rear, a trailer, or any other suitable surface, including those that are not vehicular. In the collapsed state, the apparatus is importantly relatively small. The scissor frame supporting the awning easily collapses to allow the vertical members to be collapsed inwardly to a side-by-side position, with the pivoting members pivoted upwardly for further compact state. The pliable awning and bib further enable lightweight collapsibility, with hook and loop positioned in various areas on the awning and bib to provide both extended positioning as well as selectively retained collapsed arrangement. Lightweight materials further enhance portability. The pivoting members which are pivotally and positionally lockable, along with the telescopic rods, provide a wide variety of selectively established positioning and extendability. Lock knobs are easy to manually use in locking the pivoting members as chosen relative to the vertical members. The bib is hingedly attached to the awning to further provide selective positioning in relation thereto.

Thus has been broadly outlined the more important features of the improved portable magnetic awning apparatus so that the detailed description thereof that follows may be better understood and in order that the present contribution to the art may be better appreciated.

An object of the portable magnetic awning apparatus is to removably fit a variety of vehicles.

Another object of the portable magnetic awning apparatus is to negate marring of a vehicle.

A further object of the portable magnetic awning apparatus is to be lightweight.

An added object of the portable magnetic awning apparatus is to be collapsible.

And, an object of the portable magnetic awning apparatus is to provide selective angular positioning.

Yet another object of the portable magnetic awning apparatus is to be highly portable.

These together with additional objects, features and advantages of the improved portable magnetic awning apparatus will be readily apparent to those of ordinary skill in the art upon reading the following detailed description of presently preferred, but nonetheless illustrative, embodiments of the improved portable magnetic awning apparatus when taken in conjunction with the accompanying drawings.

DETAILED DESCRIPTION OF THE DRAWINGS

With reference now to the drawings, and in particular FIGS. 1 through 5 thereof, the principles and concepts of the portable magnetic awning apparatus generally designated by the reference number 10 will be described.

Figure 1:
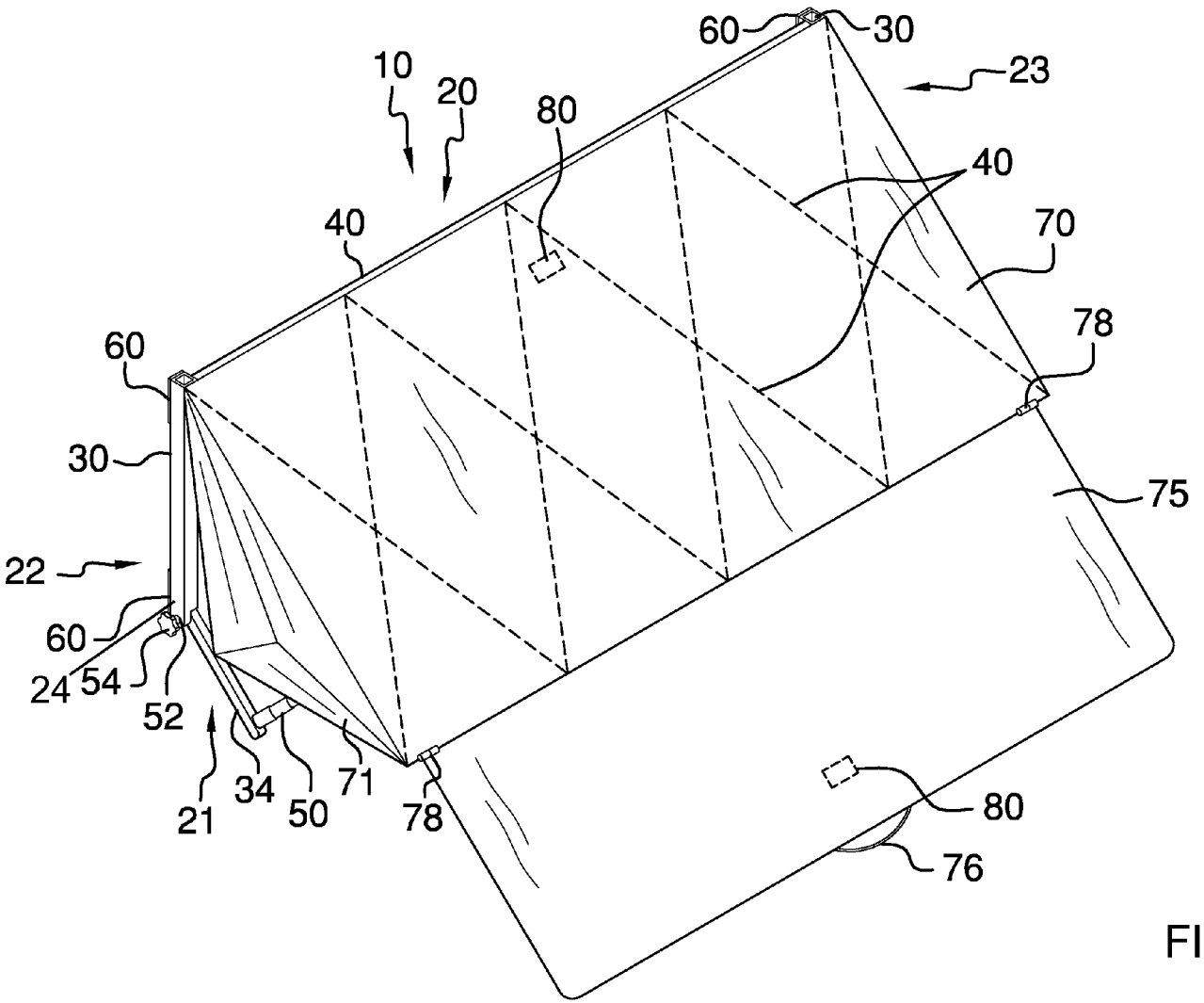
FIG. 1 is a top perspective view, expanded.

Referring to FIG. 1, the apparatus 10 partially comprises the top 20 spaced apart from the bottom 21. The first end 22 is selectively spaced apart from the second end 23.

Figure 2:
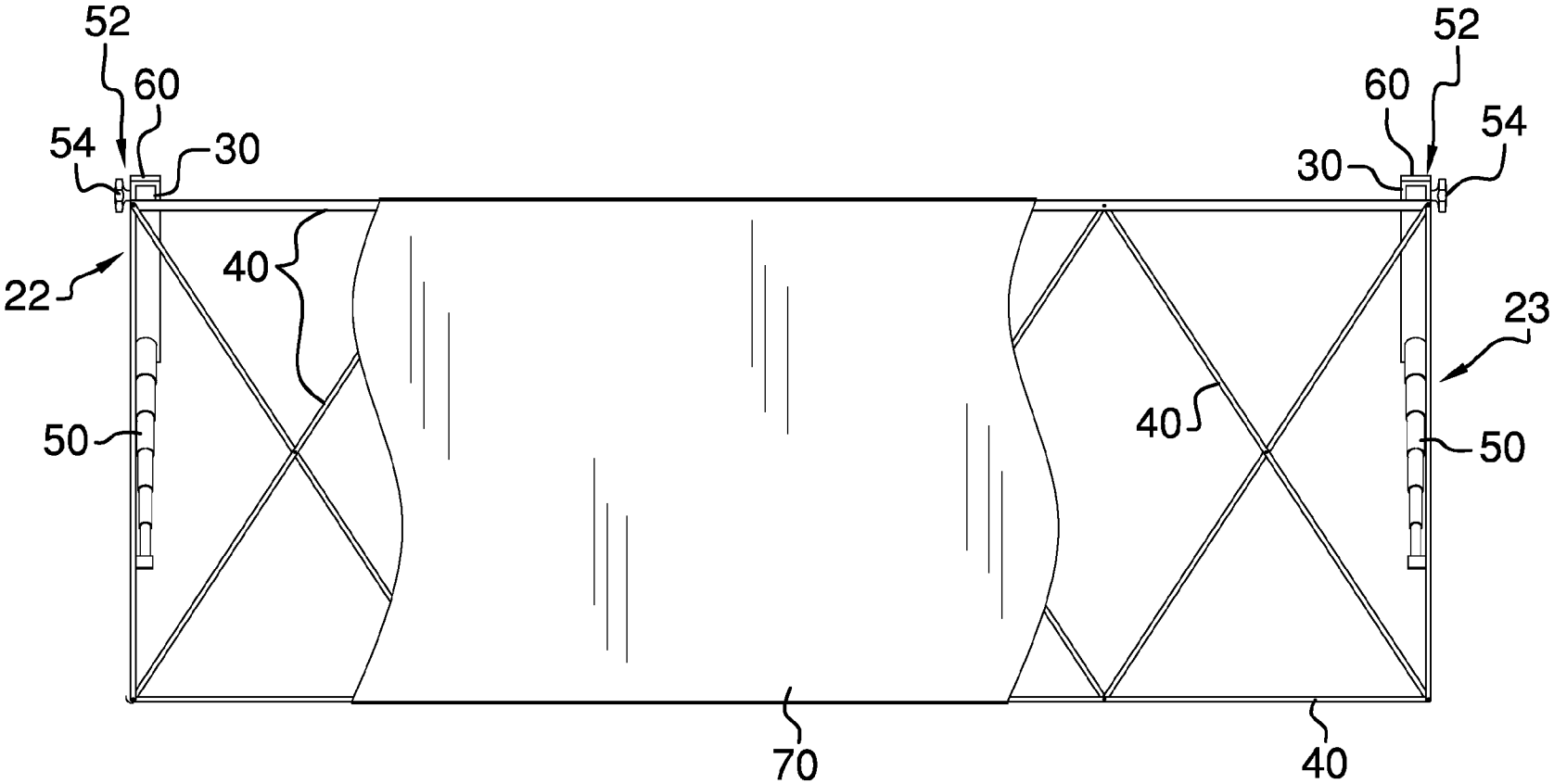
FIG. 2 is a partial cutaway top plan view.

Continuing to refer to FIG. 1 and referring also to FIG. 2, the pair of selectively spaced apart vertical members 30 is extended from the top 20 to the lower end 24. One of each of the identical vertical members 30 is disposed at the first end 22 and one at the second end 23.

Figure 4:
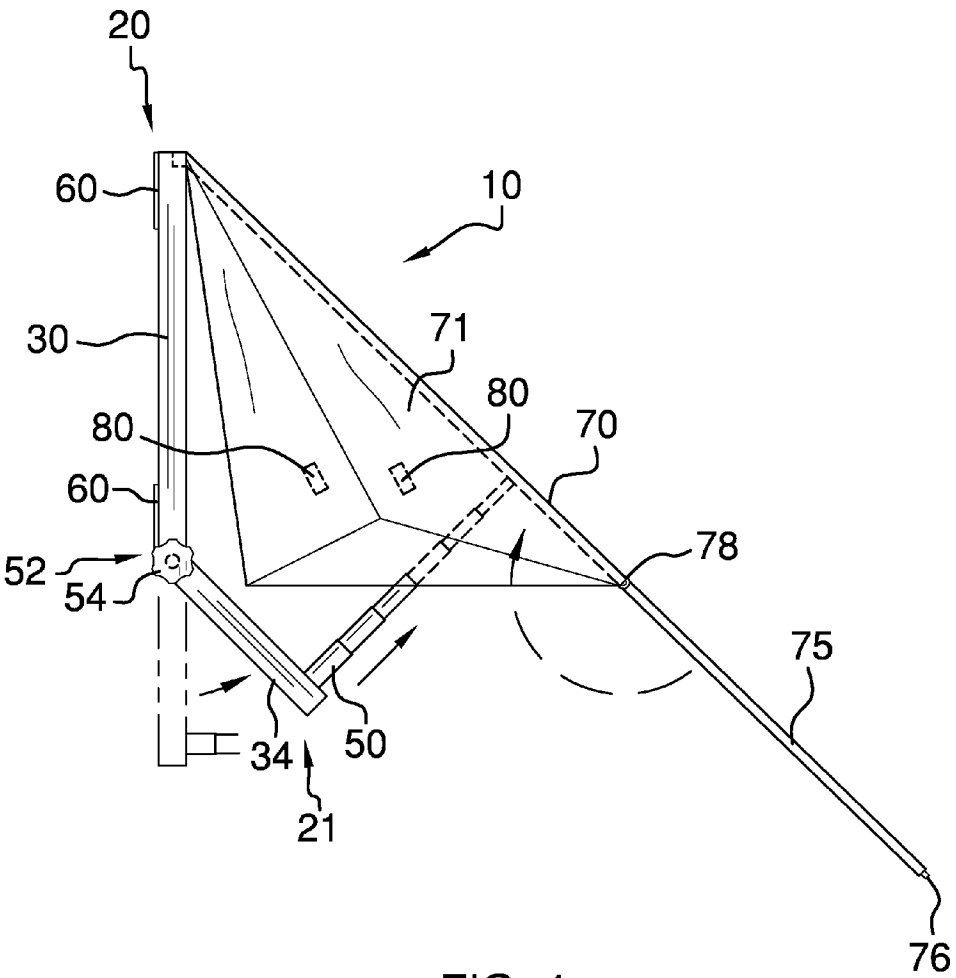
FIG. 4 is a lateral elevation view with pivoting member pivoted partially outward and telescopic rod partially extended.
Figure 3:
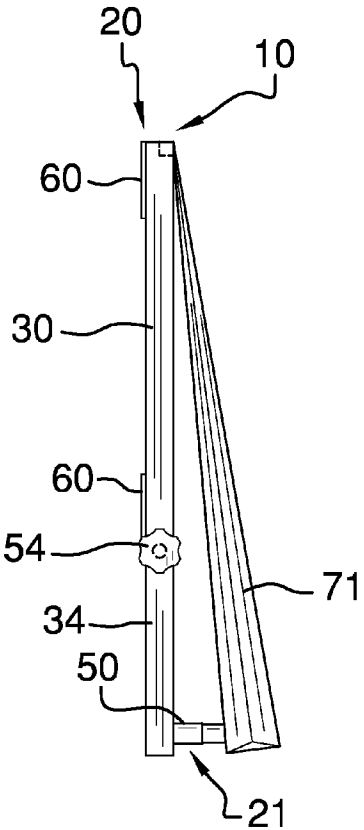
FIG. 3 is a lateral elevation view, with telescopic rod substantially collapsed and pivoting member pivoted toward the bottom.

Referring to FIG. 4 and continuing to refer to FIG. 2, an identical pivoting member 34 is extended from each vertical member 30 bottom by a pivot 52. A lock knob 54 is disposed at each pivot 52.

Referring to FIG. 3 and again to FIG. 4, each pivoting member 34 is selectively positioned in relation to each vertical member 30. A telescopic rod 50 is extended perpendicularly and distally from each pivoting member 34. Each telescopic rod 50 is affixed to the scissor frame 40 most proximal to the bottom 21. A soft magnet 60 is disposed rearwardly on each vertical member 30 top 20. A soft magnet 60 is disposed rearwardly on each vertical member 30 lower end 24.

Referring again to FIGS. 1 and 2, the collapsible, expandable scissor frame 40 is disposed between the vertical members 30. The scissor frame 40 is attached forwardly at each vertical member 30 top 20. A pair of spaced apart hinges 78 affixed to the scissor frame 40 bottom 21. The pliable awning 70 is affixed to the scissor frame 40. A pliable triangular side panel 71 is affixed to the first end 22 of the awning 70. A pliable triangular side panel 71 is affixed to the second end 23 of the awning 70. The pliable bib 75 is affixed to the hinges 78.

Referring again to FIG. 1 and FIG. 4, plurality of spaced apart hook and loop 80 is disposed on each of the awning 70 and the bib 75. The hook and loop 80 provides for a user to retainably collapse the apparatus 10. The handle 76 is disposed outwardly on the bib 75 and provides convenience.

Figure 5:
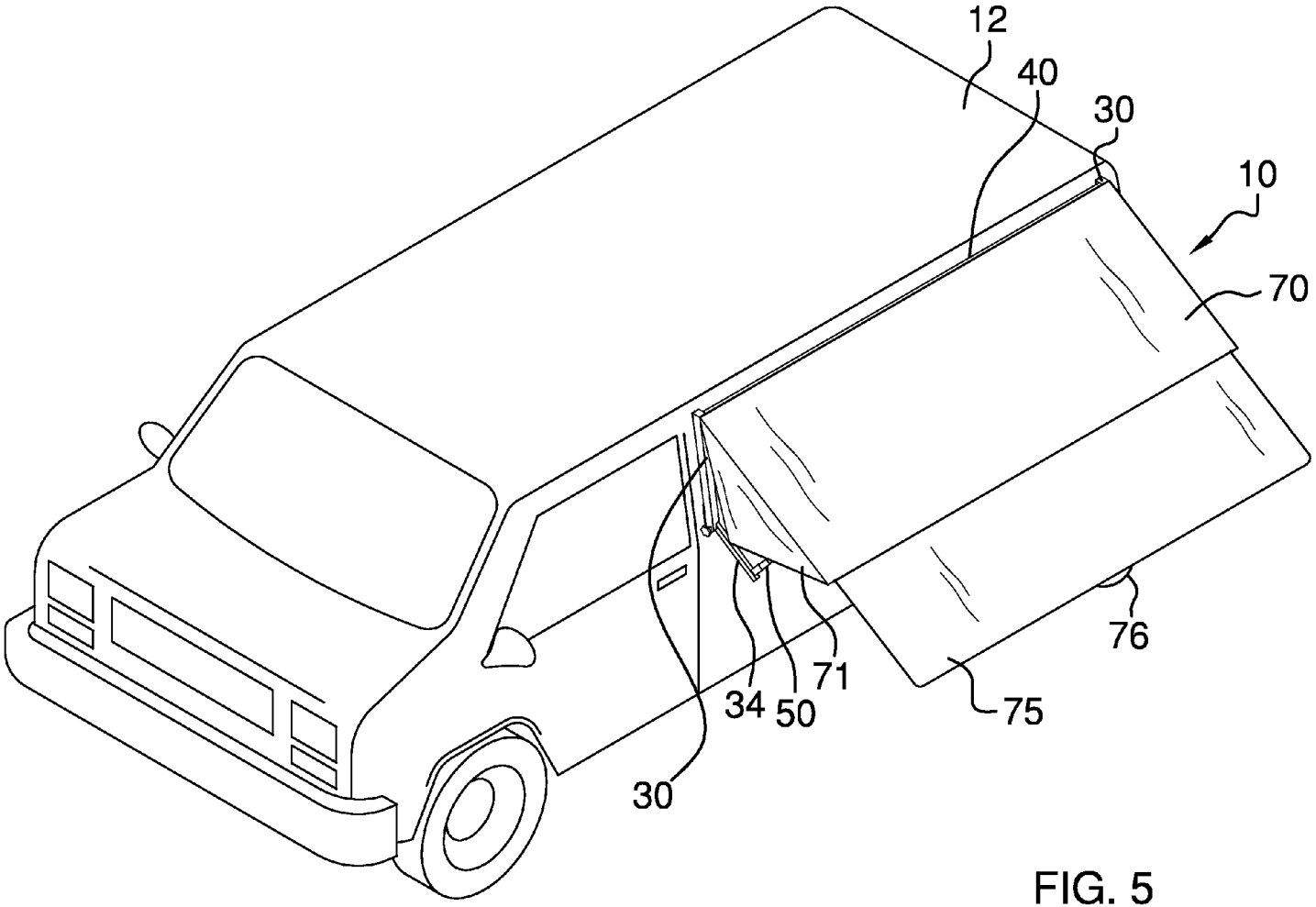
FIG. 5 is a top perspective view of the apparatus installed, expanded, and pivoted partially outward.

Referring to FIG. 5, the apparatus 10 is removably affixed to the vehicle 12, with awning 70 and bib 75 extended outwardly and downwardly.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable magnetic awning apparatus may be used.

What is claimed is:

1. A portable magnetic awning apparatus comprising, in combination:

a top spaced apart from a bottom, a first end selectively spaced apart from a second end;

a pair of identical selectively spaced apart vertical members extended from the top to the bottom, one of the vertical members disposed at the first end and one at the second end;

a collapsible, expandable scissor frame disposed between the vertical members, the scissor frame attached forwardly at each vertical member top;

an identical pivoting member extended from each vertical member bottom, each of one of the pivoting members affixed to one of each of the vertical members by a pivot;

a lock knob disposed at each pivot whereby each pivoting member is selectively positioned in relation to each vertical member;

a telescopic rod extended perpendicularly and distally from each pivoting member, each telescopic rod affixed to the scissor frame most proximally to a bottom of the scissor frame for opening and closing the scissor frame;

a soft magnet disposed rearwardly on each vertical member top;

a soft magnet disposed rearwardly on each vertical member bottom lower end;

a pliable awning affixed to the scissor frame;

a plurality of spaced apart hook and loop disposed on the awning.

2. A portable magnetic awning apparatus comprising, in combination:

a top spaced apart from a bottom, a first end selectively spaced apart from a second end;

a pair of identical selectively spaced apart vertical members extended from the top to the bottom, one of the vertical members disposed at the first end and one at the second end;

a collapsible, expandable scissor frame disposed between the vertical members, the scissor frame attached forwardly at each vertical member top;

an identical pivoting member extended from each vertical member bottom, each of one of the pivoting members affixed to one of each of the vertical members by a pivot;

a lock knob disposed at each pivot whereby each pivoting member is selectively positioned in relation to each vertical member;

a telescopic rod extended perpendicularly and distally from each pivoting member, each telescopic rod affixed to the scissor frame most proximally to a bottom of the scissor frame for opening and closing the scissor frame;

a soft magnet disposed rearwardly on each vertical member top;

a soft magnet disposed rearwardly on each vertical member bottom lower end;

a pair of spaced apart hinges affixed to the scissor frame bottom;

a pliable awning affixed to the scissor frame;

a pliable bib affixed to the hinges;

a handle disposed outwardly on the bib;

a plurality of spaced apart hook and loop disposed on each of the awning and the bib.

3. A portable magnetic awning apparatus comprising, in combination:

a top spaced apart from a bottom, a first end selectively spaced apart from a second end;

a pair of identical selectively spaced apart vertical members extended from the top to the bottom, one of the vertical members disposed at the first end and one at the second end;

a collapsible, expandable scissor frame disposed between the vertical members, the scissor frame attached forwardly at each vertical member top;

an identical pivoting member extended from each vertical member bottom, each of one of the pivoting members affixed to one of each of the vertical members by a pivot;

a lock knob disposed at each pivot whereby each pivoting member is selectively positioned in relation to each vertical member;

a telescopic rod extended perpendicularly and distally from each pivoting member, each telescopic rod affixed to the scissor frame most proximally to a bottom of the scissor frame for opening and closing the scissor frame;

a soft magnet disposed rearwardly on each vertical member top;

a soft magnet disposed rearwardly on each vertical member bottom lower end;

a pair of spaced apart hinges affixed to the scissor frame bottom;

a pliable awning affixed to the scissor frame;

a pliable triangular side panel affixed to the first end of the awning;

a pliable triangular side panel affixed to the second end of the awning;

a pliable bib affixed to the hinges;

a plurality of spaced apart hook and loop disposed on each of the awning and the bib.

* * * * *